US005430004A

United States Patent [19]

Oshima et al.

[11] Patent Number: 5,430,004

[45] Date of Patent: Jul. 4, 1995

[54] HEAT TRANSFER SHEET

[75] Inventors: Katsuyuki Oshima; Hideo Fujimura; Minoru Furuse, all of Tokyo, Japan

[73] Assignee: Dai Nippon Insatsu Kabushiki Kaisha, Japan

[21] Appl. No.: 191,275

[22] Filed: Feb. 3, 1994

Related U.S. Application Data

[63] Continuation of Ser. No. 635,515, filed as PCT/JP90/00715, Jan. 1, 1990, abandoned.

[30] Foreign Application Priority Data

| | | | |
|---|---|---|---|
| Jun. 2, 1989 | [JP] | Japan | 1-140676 |
| Jun. 2, 1989 | [JP] | Japan | 1-140677 |
| Feb. 22, 1990 | [JP] | Japan | 2-39665 |
| Feb. 22, 1990 | [JP] | Japan | 2-39666 |

[51] Int. Cl.[6] ..... B41M 5/035; B41M 5/38

[52] U.S. Cl. ..... 503/227; 428/195; 428/421; 428/422; 428/423.1; 428/447; 428/474.4; 428/480; 428/500; 428/532; 428/913; 428/914

[58] Field of Search ..... 8/471; 428/195, 913, 428/914, 447, 421, 422, 423.1, 447, 474.4, 480; 503/227

[56] References Cited

U.S. PATENT DOCUMENTS

| | | | |
|---|---|---|---|
| 4,724,228 | 2/1988 | Hann | 503/227 |
| 4,990,485 | 2/1991 | Egashiva et al. | 503/227 |
| 5,043,318 | 8/1991 | Kawakami et al. | 503/227 |
| 5,063,198 | 11/1991 | Imai et al. | 503/227 |
| 5,118,657 | 6/1992 | Kawakami et al. | 503/227 |
| 5,124,309 | 6/1992 | Egashira | 503/227 |
| 5,144,334 | 9/1992 | Suzuki et al. | 346/1.1 |

FOREIGN PATENT DOCUMENTS

| | | | |
|---|---|---|---|
| 2-141289 | 5/1990 | Japan | 503/227 |

*Primary Examiner*—B. Hamilton Hess

*Attorney, Agent, or Firm*—Parkhurst, Wendel & Rossi

[57] ABSTRACT

This invention relates to a heat transfer sheet including a substrate film and a dye layer formed on the surface of the substrate film, the dye layer containing a dye and a binder resin and, if required, a release agent. The binder resin and/or release agent include a graft copolymer containing at least releasable segment selected from polysiloxane, carbon fluoride and long-chain alkyl segments grafted onto its major chain. According to this invention, there is provided a heat transfer sheet which enables an image of high density to be made at high speeds with neither adhesion between the dye layer and the dye-receiving layer nor peeling-off of the dye layer at the time of heat transfer and can produce an image on the surface of which a transparent film can be laminated.

25 Claims, 1 Drawing Sheet

HEAT TRANSFER SHEET

This is a Continuation of application Ser. No. 07/635,515 filed as PCT/JP90/00715, Jan. 1, 1990, now abandoned.

TECHNICAL FIELD

The present invention relates to a heat transfer sheet used with a sublimable dye (or a thermally migrating dye) and, more particularly, seeks to provide a heat transfer sheet enabling recording to be effected at high speed and a transferred image to be formed at high density.

BACKGROUND TECHNIQUE

As an alternative to typographic and printing techniques so far generally available in the art, ink jet, heat transfer and other systems have been developed to make excellent monochromatic or full-colored images in simpler and faster manners. The most advanced of all is the so-called sublimation heat transfer system making use of a sublimable dye to give full-colored images of excellent continuous gray scale comparable to color photographs.

In general, heat transfer sheets used with the sublimation type heat transfer system each include a substrate film such as a polyester film, having a sublimable dye-containing dye layer formed on one surface and a heat-resistant layer provided on the other surface so as to prevent it from sticking to a thermal head.

Such a heat transfer sheet is overlaid at the surface of its dye layer on an image-receiving sheet containing an image-receiving layer made of a resin such as polyester, and is then heated from its back surface in an imagewise form with a thermal head, thereby transferring the resin from the dye layer onto the image-receiving sheet to form the desired image.

The heat transfer system is advantageous in that shading levels of an image can be determined by increasing or decreasing the temperature of a thermal head. A problem with this technique, however, is that as the temperature of the thermal head is elevated to increase the density of the image, the dye layer-forming binder softens to such an extent that it adheres to the image-receiving sheet, causing the heat transfer sheet to bond to the image-receiving sheet or, at worst, the dye layer to be transferred from the substrate film immediately onto the image-receiving sheet at the time of releasing.

In order to solve such a problem, it has been proposed to incorporate a release agent such as silicone oil in the dye-receiving layer of the image-receiving sheet. A problem with this proposal, however, is that due to being liquid at normal temperature, the silicone oil tends to bleed through the dye-receiving layer, posing blocking and contamination problems. Use of a heat curable silicone oil, on the other hand, has been envisaged. Required to this end, however, are heat treatments after the formation of the dye-receiving layer, which make manufacturing steps very troublesome.

Imparting sufficient release properties to the dye-receiving sheet may also be achieved by the addition of a relatively large amount of silicone; however, this will result in a drop of dye receptivity and a degradation of the storability of the dye-receiving layer.

Also, when a transparent film is to be laminated on the surface of the resulting image for its protection, it would be difficult, if not possible, to achieve satisfactory lamination, because the image layer contains a release agent.

Addition of a release agent to the dye layer of a heat transfer sheet in an amount nothing short of imparting some release effect to it, on the other hand, will result in dye bleeding or discoloration, or make it unusable due to a drop of its storability.

It is, therefore, an object of this invention to provide a heat transfer sheet which can be produced in a much simpler manner, enables an image of high density to be formed at high speed with the prevention of a drop of the thermal migration of a dye and with neither adhesion between the dye layer and the dye-receiving layer nor peeling of the dye layer at the time of heat transfer, and renders it possible to make an image on the surface of which a transparent film can be laminated.

DISCLOSURE OF THE INVENTION

The above object of this invention is realized by the provision of the following heat transfer sheet.

More specifically, the present invention provides a heat transfer sheet including a substrate film having on one surface a dye containing dye layer and a binder resin and, if required, a release agent, characterized in that said binder resin and/or release agent comprises a graft copolymer containing at least one releasable segment selected from polysiloxane, carbon fluoride and long-chain alkyl segments grafted onto its major chain.

In the present disclosure, the "polymer" used as the binder resin and/or release agent in this invention refers to a polymer having a releasable segment grafted onto its major chain. As schematically illustrated in FIG. 1, the releasable segment is grafted onto the major chain of the polymer as a side chain.

In general, the releasable segment of such a releasable polymer is less compatible in itself with the aforesaid binder resin. Thus, when that polymer is incorporated in a dye layer, its releasable segment tends to bleed through the dye layer by microscopic phase separation.

If the major chain forming part of the polymer selected is well compatible with the aforesaid binder resin, then it is more likely to be retained in the dye layer. These actions, once synergistically combined with each other, would make the surface of the dye layer rich in the releasable segment, as best seen in FIG. 2, producing good release properties. However, the major chain grabs hold of the releasable segment in the dye layer, so that the releasable polymer can never pass onto other articles, especially the surface of the dye-receiving layer.

BEST MODE FOR CARRYING OUT THE INVENTION

Figure 1:
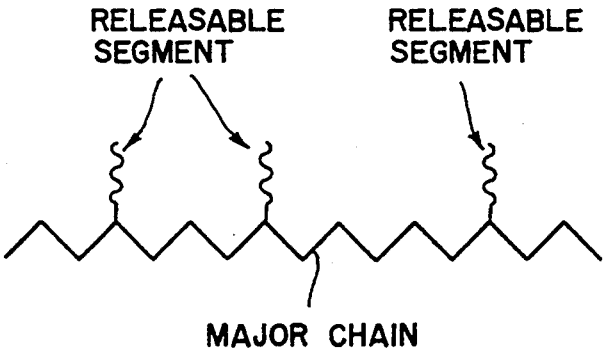
FIG. 1 is a schematic view illustrative of the fundamental structure of a typical graft copolymer used as the binder resin or release agent in this invention.
Figure 2:
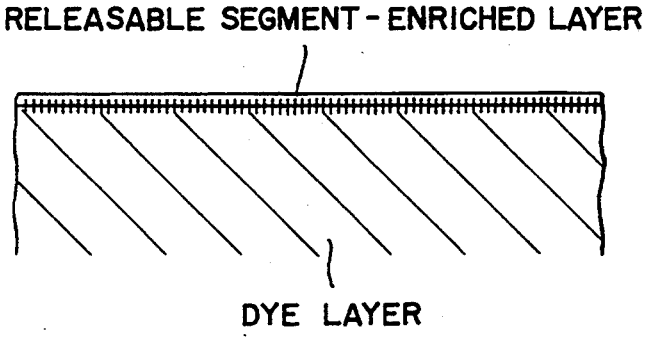
FIG. 2 is a schematic section illustrative of the dye layer of a typical heat transfer sheet according to this invention.

The present invention will now be explained in greater detail but not exclusively with reference to several preferable embodiments.

The substrate film of the heat transfer sheet according to this invention may be made of any known material having some heat resistance and strength. For instance, mention is made of paper, various processed papers, polyester films, polystyrene films, polypropylene films, polysulfone films, aramid films, polycarbonate films, polyvinyl alcohol films and cellophane, all having a thickness of, e.g. 0.5–50 μm, preferably 3–10 μm. Particularly preferable to this end is a polyester film.

The substrate film should preferably be primer- or corona discharge-treated on its surface, if it is found to be poor in its adhesion to the dye layer to be formed on its surface.

A layer of a sublimable (or thermally migrating) dye to be formed on the substrate film is a layer in which the dye is carried by any suitable binder resin, and which may contain a release agent, if required, as will be described hereinafter.

Dyes so far used with conventional heat transfer sheets may all be effectively used for this invention. In this regard, no particular limitation is imposed on this invention. By way of example alone, mention is made of red dyes such as MS Red G, Macrolex Red Violet R, Ceres Red 7B, Samaron Red HBSL and Resolin Red F3BS; yellow dyes such as Phorone Brilliant Yellow 6GL, PTY-52 and Macrolex Yellow 6G; and blue dyes such as Kayaset Blue 714, Vacsolin Blue AP-FW, Phorone Brilliant S-R and MS Blue 100.

In order to carry such thermally migrating dyes as mentioned above, binder resins so far known in the art may all be used. By way of example alone, use may be made of cellulosic resins such as ethyl cellulose, hydroxyethyl cellulose, ethylhydroxy cellulose, hydroxypropyl cellulose, methyl cellulose, cellulose diacetate, cellulose triacetate and cellulose acetate butyrate; vinylic resins such as polyvinyl alcohol, polyvinyl acetate, polyvinyl acetal acetate, polyvinyl pyrrolidone and polyacrylamide; and polyester resins. Among others, however, particular preference is given to resins based on cellulose, acetal, (butyral, acetacetal, etc.) and polyester.

The present invention is characterized in that the following graft copolymer is used in addition to, or in place of, the aforesaid binder resin.

The polymer used as the release agent and/or binder in this invention is a graft copolymer containing at least one releasable segment selected from polysiloxane, carbon fluoride and long-chain alkyl segments grafted onto its major chain.

The releasable copolymers may be synthesized in various processes. In one preferable process, a major chain is first formed, and a reactive functional group found in said major chain is then permitted to react with a releasable compound having a reactive functional group reactive with the first-mentioned functional group.

Examples of the releasable compounds containing such functional groups are:

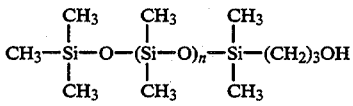
(1)

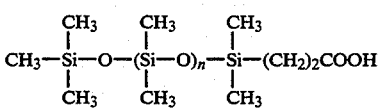
(2)

-continued

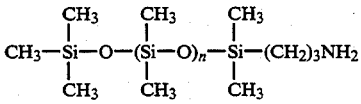
(3)

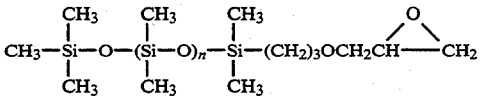
(4)

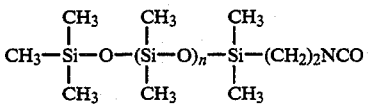
(5)

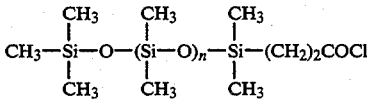
(6)

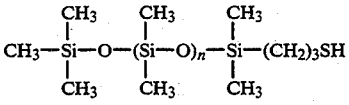
(7)

It should be noted connection with the above formulae that a part of the methyl group may be substituted by other alkyl group or an aromatic group such as a phenyl group.

(b) Carbon fluoride compounds $C_8F_{17}C_2H_4OH$ (8)

$C_6F_{13}C_2H_4OH$ (9)

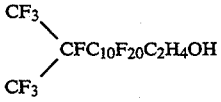
(10)

$C_8F_{17}C_2H_4OH$ (11)

$C_{10}F_{21}C_2H_4OH$ (12)

$C_8F_{17}SO_2N(C_2H_5)C_2H_4OH$ (13)

$C_8F_{17}SO_2N(C_2H_5)C_2H_4OH$ (14)

$C_6F_{13}COOH$ (15)

$C_6F_{13}COCl$ (16)

$C_8F_{17}C_2H_4SH$ (17)

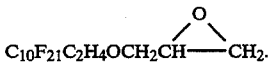
(18)

(c) Long-chain alkyl compounds higher fatty acids such as lauric, myristic, palmitic, stearic, oleic and linoleic acids and their acid halogenides; higher alcohols such as nonyl, capryl, lauryl, myristyl, cetyl, stearyl, oleyl, linoleyl and ricinoleyl alcohols; higher aldehydes such as caprylaldehyde, laurylaldehyde, myristylaldehyde and stearylaldehyde; and higher amines such as decylamine, laurylamine and cetylamine.

The above releasable compounds are mentioned by way of example alone. Other various reactive releasable compounds may be available from, for instance, The Shin-Etsu Chemical Co., Ltd. or other firms. Particular preference is given to a monofunctional releasable compound having a single functional group in its molecule, because the use of di- or poly-functional compounds cause the resulting graft copolymers to tend to gelate.

The relationship between the functional releasable compounds and the major chain polymers is shown in Table 1, wherein X is the functional group of the releasable compound and Y is the functional group of the major chain polymer, and vice versa. Both the compounds and polymers may be mixed together for use. If they are reactive with each other, therefore, there is then no intention of limitations to the examples tabulated on the following page.

TABLE 1

| X | Y |
|---|---|
| —NCO | —OH, —$NH_2$, —NHR—, —COOH, —SH, etc. |
| —COCl | —OH, —$NH_2$, —NHR—, —SH, etc. |
| 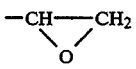 | —OH, —$NH_2$, —COOH, etc. |
| 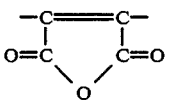 | —OH, —$NH_2$, —NHR—, —SH, etc. |
| —OH, —SH | 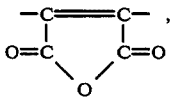 , —NCO, —COOR, —CHO, —CHO, —COCl, —COOH, etc. |
| —$NH_2$, —NHR— | 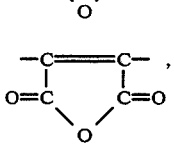 , —NCO, —COOH, —COCl, 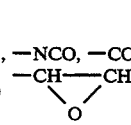 , etc. |
| —COOH | 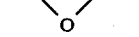 , —NCO, —OH, —$NH_2$, —NHR—, etc. |

In an alternative process suitable for this invention, the functional group of the releasable compound is allowed to react with a functional group—reactive therewith—of a vinyl compound to form a monomer containing a releasable segment. The desired graft copolymers may again be obtained by the copolymerization of the monomer with various vinyl monomers.

In a further preferable process, a mercapto compound such as Compound (7) or the above-mentioned releasable vinyl compound is grafted onto a polymer having an unsaturated double bond in its major chain such as an unsaturated polyester or a copolymer of a vinyl monomer with a diene compound, e.g. butadiene.

While the foregoing are preferable preparative processes, it should be understood that graft copolymers obtained by other processes may be used in this invention.

Releasable polymers particularly fit for this invention in consideration of compatibility with the binder resins and/or affinity for the dyes have as major chains acrylic, vinylic, polyester, polyurethane, polyamide or cellulosic resins.

According to this invention, much more improved properties are achievable by permitting polyvinyl acetal to form the major chain of the graft copolymer constituting the aforesaid release agent or releasable binder. In this connection, the term "polyvinyl acetal" should admit of very wide interpretation. To put it another way or by definition, a polyvinyl acetal compound in which part of its acetal moiety is formaldehyde is referred to as polyvinyl formal; a polyvinyl acetal compound in which part of its acetal moiety is acetaldehyde as polyvinyl acetal; and a polyvinyl acetal compound in which part of its acetal moiety is butylaldehyde as polyvinyl butyral. Thus, it should be understood that the term "polyvinyl acetal" include all these acetal compounds.

In order to prepare a graft copolymer by grafting the polysiloxane segment onto the major chain containing such a polyvinyl acetal as mentioned above, for instance, a polysiloxane containing a functional group and a diisocyanate may be permitted to react with each other to prepare a silicone chain for grafting, which may in turn be grafted onto the polyvinyl acetal. More illustratively, hexamethylene diisocyanate and a dimethyl polysiloxane having a hydroxyl group at its one terminal, for instance, are permitted to react with each other at a reaction temperature of about 50°–100° C. in a solvent containing MEK and MIBK at 1:1 and in the presence of about 0.01–1.0% by weight of a tin catalyst (e.g. dibutyltin) to prepare a silicone chain for grafting. Then, this silicone chain and a polyvinyl acetal resin are permitted to react with each other in a solvent containing MEK and MIBK at 1:1, thereby preparing a silicone-grafted-onto-acetal copolymer.

As the major chains polyvinyl acetal and polyvinyl butyral are preferably used. Preferable as the polyvinyl butyral is one represented by the following structural formula and having a hydroxyl content (ml) of 5–40% by weight, preferably 14–36% by weight and a polymerization degree of 700–2400, preferably 1700–2400.

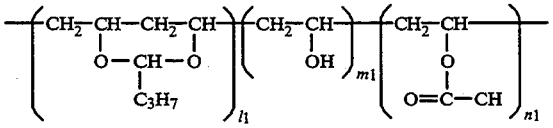

wherein $l_1$, $m_1$ and $n_1$ stand for the contents in % by weight of the respective units in the polymer.

Preferable as the polysiloxane chain grafted onto the major chain, on the other hand, may be a siloxane chain represented by the following structural formula and having a molecular weight of about 1,000–2,500, preferably 1,500–2,000 and a polymerization degree (n) of 3–48, preferably 8–18, with the rate-grafted-onto-the-major-chain-butyral (hereinafter simply called the grafting rate) lying in the range of 0.1–40%, preferably 1–10%.

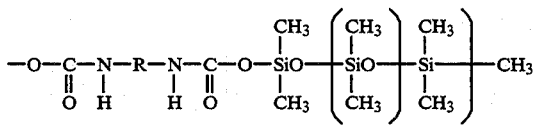

$$G.R. = \frac{\text{Siloxane chain (wt)}}{\text{Major chain butyral (wt)} + \text{Siloxane chain (wt)}} \times 100\ (\%)$$

*G.R.*: Grafting Rate

Suitably, the dye layer according to this invention may contain only limited amounts of organic or inorganic powders in a finely divided form. Such powders serve to improve film forming properties when forming the dye layer and make a contribution to improvements in release properties at the time of heat transfer printing. In this regard, the finely divided organic powders are more preferable.

Preferable organic powders may be obtained by finely dividing polyolefinic resins such as polyethylene and polypropylene, fluorocarbon resins, polyamide resins such as nylon, styrene resins, styrene/acrylic crosslinked resins, phenolic resins, urea resins, melamine resins, polyimide resins and benzoguanamine resins. Of these, polyethylene powders are most preferable.

Preferable inorganic powders may be obtained by finely dividing calcium carbonate, silica, clay, talc, titanium oxide, magnesium hydroxide and zinc oxide.

According to this invention, other dye layers of laminated structures may be used, as mentioned below.

1) A heat transfer sheet having a double dye layer comprising one sublayer containing an acetal polymer with no silicone grafted onto it and the other sublayer containing a release agent comprising a silicone-grafted-onto-acetal polymer, which are laminated on the surface of the substrate film in that order.

2) A heat transfer sheet in which a primer layer comprising a polyacetal resin is interleaved between a substrate film and a dye layer.

3) A heat transfer sheet including a substrate film on the surface of which a dye and binder resin-containing dye layer and a release agent-containing overlay are formed in this order, said release agent contained in this overlay comprising a silicone-grafted-onto-acetal polymer.

When the graft copolymer is used as the release agent, the content of the releasable segment in said release agent should preferably account for 10–80% by weight of the graft copolymer. A graft copolymer having too small a releasable segment content is unpreferred, since it fails to produce sufficient release properties. On the other hand, a graft copolymer having too large a releasable segment content is again unpreferred, since it becomes so poor in its compatibility with the binder that dye migration and other problems can arise. When added to the dye layer, the release agent or agents may preferably be used in an amount of 1–40 parts by weight per 100 parts by weight of the binder resin. It will fail to produce sufficient releasability in too small an amount, whereas they give rise to dye migration and a drop of the strength of the resulting film, offering problems in connection with dye discoloration and storability.

When the above graft copolymer is used as the binder, on the other hand, it is preferable that the releasable segment accounts for 0.5–40% by weight of said binder resin. It will fail to produce sufficient releasability in too small an amount, whereas it will give rise to dye migration and a strop of the strength of the resulting film, offering problems in connection with dye discoloration and storability.

Basically formed of the above-mentioned materials, the dye layer of the heat transfer sheet according to this invention, if required, may contain various known additives so far used in the art.

Preferably, the dye layer is formed by dissolving or dispersing the aforesaid sublimable dye and binder resin together with other desired components in a suitable solvent to prepare a coating or ink material for forming the dye layer and coating that material on the substrate film, followed by drying.

The thus formed dye layer has a thickness of 0.2–5.0 μm, preferably 0.4–2.0 μm, and contain the sublimable dye in an amount of 5–90% by weight, preferably. 10–70% by weight based on the weight thereof.

The heat transfer sheet according to this invention may be-provided on its back surface with a heat-resistant layer to prevent the heat of a thermal head from having an adverse influence on it.

An image-receiving sheet used to form images with such a heat transfer sheet as mentioned above may be made of any material having dye receptivity on its recording surface. If it is made of a paper, metal, glass or synthetic resin film or sheet having no dye receptivity, then it may be provided on at least one surface with a dye-receiving layer of a resin having good dyeability. Such a dye-receiving layer may also contain as a release agent solid wax such as polyethylene wax, amide wax or Teflon powder, a surface active agent based on fluorine or phosphate, silicone oil or the like, all heretofore known in the art, in such an amount that the object of this invention is well achievable.

As means for applying heat energy when heat transfer is carried out with the heat transfer sheet according to this invention, any known means may be used. For instance, the desired object is well achieved by the application of a heat energy of about 5–100 mJ/mm$^2$ for a recording time controlled by recording hardware such as a thermal printer (e.g. Video Printer VY-100 made by Hitachi, Ltd.).

According to the present invention wherein, as explained above, the graft copolymer containing a releasable segment grafted onto its major chain is used as the release agent and/or binder added to the dye layer, there is provided a heat transfer sheet which can be produced in a much simpler manner, enables an image of high density to be formed at high speed with the prevention of a drop of the thermal migration of a dye and with neither adhesion between the dye layer and the dye-receiving layer nor peeling of the dye layer at the time of heat transfer, and renders it possible to make an image on the surface of which a transparent film can be laminated.

The present invention will now be explained in greater detail with reference to the following reference examples, examples and comparative examples wherein, unless otherwise stated, the "parts" and "%" are given by weight.

REFERENCE EXAMPLE A1

Thirty (30) parts of a copolymer (M.W.: 80,000) of 90 mol % of methyl methacrylate with 10 mol % of hydroxyethyl methacrylate were dissolved in 400 parts of a mixed solvent consisting of equal amounts of methyl ethyl ketone and toluene. Then, 40 parts of Polysiloxane Compound (5) were slowly added dropwise to the solution for a 5-hour reaction at 60° C., which gave a homogeneous product. This product, from which the polysiloxane compound could not be separated by fractional precipitation, was a reaction product of the polysiloxane compound with the acrylic resin. By analysis, the amount of the polysiloxane segment was found to be about 55.3%.

REFERENCE EXAMPLE A2

Fifty (50) parts of polyvinyl butyral (having a polymerization degree of 1,700 and a hydroxyl content of 33 mol %) were dissolved in 500 parts of a mixed solvent consisting of equal amounts of methyl ethyl ketone and toluene. Then, 20 parts of Polysiloxane Compound (5) were gradually added dropwise to the solution for a 5-hour reaction at 60° C., which gave a homogeneous product. The product, from which the polysiloxane compound could not separated by fractional precipitation, was a reaction product of the polysiloxane compound with the polyvinyl butyral resin. By analysis, the amount of the polysiloxane segment was found to be about 26.7%.

REFERENCE EXAMPLE A3

Seventy (70) parts of a polyester (M.W.: 25,000) of 45 mol % of dimethyl terephthalate, 5 mol % of dimethyl monoaminoterephthalate and 50 mol % of trimethylene glycol were dissolved in 700 parts of a mixed solvent consisting of equal amounts of methyl ethyl ketone and toluene. Then, 20 parts of Polysiloxane Compound (7) were slowly added dropwise to the solution for a 5-hour reaction at 60° C., which gave a homogeneous product. The product, from which the polysiloxane compound could not separated by fractional precipitation, was a reaction product of the polysiloxane compound with the polyester resin. By analysis, the amount of the polysiloxane segment was found to be about 21.9%.

REFERENCE EXAMPLE A4

Fifty (50) parts of a polyurethane resin (M.W.: 6,000) obtained from polyethylene adipate diol, butanediol and hexamethylene diisocyanate were dissolved in 800 parts of a mixed solvent consisting of equal amounts of methyl ethyl ketone and toluene. Then, 30 parts of Polysiloxane Compound (6) were slowly added dropwise to the solution for a 5-hour reaction at 60° C., which gave a homogeneous product. The product, from which the polysiloxane compound could not separated by fractional precipitation, was a reaction product of the polysiloxane compound with the polyurethane resin. By analysis, the amount of the polysiloxane segment was found to be about 35.1%.

REFERENCE EXAMPLE A5

One hundred (100) parts of a mixture of 40 mol % of a monomer obtained by the reaction of Polysiloxane Compound (3) with methacrylic acid chloride, 40 mol % of methyl methacrylate, 10 mol % of butyl acrylate and 10 mol % of styrene and 3 parts of azobisisobutyronitrile were dissolved in 1,000 parts of a mixed solvent consisting of equal amounts of methyl ethyl ketone and toluene, followed by a 6-hour polymerization at 70° C. which gave a viscous polymer solution in a homogeneous form. From the product, the polysiloxane compound could not be separated by fractional precipitation. By analysis, the amount of the polysiloxane segment was found to be about 61.0%.

REFERENCE EXAMPLE A6

Fifty (50) parts of a styrene/butadiene copolymer (having a molecular weight of 150,000 and a butadiene content of 10 mol %) and 2 parts of azobisisobutyronitrile were dissolved in 500 parts of a mixed solvent consisting of equal amounts of methyl ethyl ketone and toluene. Then, 20 parts of Polysiloxane Compound (7) were slowly added dropwise to the solution for a 5-hour reaction at 60° C., which gave a homogeneous product. The product, from which the polysiloxane compound could not separated by fractional precipitation, was a reaction product of the polysiloxane compound with the copolymer. By analysis, the amount of the polysiloxane segment was found to be about 25.2%.

REFERENCE EXAMPLE A7

Eighty (80) parts of hydroxyethyl cellulose were dissolved in 800 parts of a mixed solvent consisting of equal amounts of methyl ethyl ketone and toluene. Then, 20 parts of Polysiloxane Compound (6) were slowly added dropwise to the solution for a 5-hour reaction at 60° C., which gave a homogeneous product. The product, from which the polysiloxane compound could not separated by fractional precipitation, was a reaction product of the polysiloxane compound with hydroxyethyl cellulose. By analysis, the amount of the polysiloxane segment was found to be about 18.6%.

REFERENCE EXAMPLE A8

The procedure of Reference A1 was followed with the exception that Carbon Fluoride Compound (16) was used in place of the polysiloxane compound, thereby obtaining a releasable graft copolymer.

REFERENCE EXAMPLE A9

The procedure of Reference A2 was followed with the exception that Carbon Fluoride Compound (18) was used in place of the polysiloxane compound, thereby obtaining a releasable graft copolymer.

REFERENCE EXAMPLE A10

The procedure of Reference A5 was followed with the exception that a methacrylate of Carbon Fluoride Compound (10) was used in place of the polysiloxane compound, thereby obtaining a releasable graft copolymer.

EXAMPLES A1–A10

Prepared were dye layer-forming ink compositions composed of the following components, each of which was then coated by means of a wire bar coater on a 6-μm thick polyethylene terephthalate, subjected on its back surface to heat-resistant treatments and made its front surface easily bondable, to a dry coverage of 1.0 g/m$^2$. Subsequent drying gave a heat transfer sheet according to this invention. When the resin had a low solubility, methylene chloride was used as a solvent.

| | |
|---|---|
| Disperse dye (Kayaset Blue 714 made by Nippon Kayaku K.K.) | 4.0 parts |
| Polyvinyl butyral resin (Slec BX-1 made by Sekisui Chemical Co., Ltd.) | 2.5 |
| Graft copolymers of Ref. Ex. Nos. A1-A10 | 2.5 |
| Methyl ethyl ketone/toluene (at a weight ratio of 1:1) | 80.0 |
| Isobutanol | 10.0 |

COMPARATIVE EXAMPLE A1

The procedure of Ex. A1 was followed with the exception that 0.3 parts of silicone oil (dimethylsiloxane) available in the trade name of KF-96 and made by The Shin-Etsu Chemical Co., Ltd.) were used in lieu of the graft copolymer, thereby obtaining a comparative heat transfer sheet.

COMPARATIVE EXAMPLE A2

Without recourse to the graft copolymers of Example A1, a comparative heat transfer sheet was obtained according to the procedure of Example A1.

REFERENCE EXAMPLE A11

With a wire bar coater, 150-μm thick synthetic paper (Yupo FRG-150 made by Oji Yuka K.K.) was coated on its one surface with a coating liquid composed of the following component to a dry coverage of 10.0 g/m$^2$ and was then dried to form a dye-receiving layer. In this way, a heat transfer image-receiving sheet was obtained.

| Composition of coating liquid | |
|---|---|
| Polyester (Vylon 600 made by Toyobo Co., Ltd.) | 11.5 parts |
| Vinyl chloride/vinyl acetate copolymer (VYHH made by UCC) | 5.0 |
| Methyl ethyl ketone/toluene/cyclohexane (at a weight ratio of 4:4:2) | 102.0 |

Each of the heat transfer sheets according to the examples and comparative examples was overlaid on the heat transfer image-receiving sheet, while the dye layer of the former was located in opposition to the dye-receiving surface of the latter. Then, recording was carried out from the back surface of the heat transfer sheet with a heat energy of 90 mJ/mm$^2$ by means of a thermal sublimation transfer printer (VY-50 made by Hitachi, Ltd.). The results are reported in Table 2.

TABLE 2

| Performance | Examples | | | | | | | | | | Comparative Example | |
|---|---|---|---|---|---|---|---|---|---|---|---|---|
| | A1 | A2 | A3 | A4 | A5 | A6 | A7 | A8 | A9 | A10 | A1 | A2 |
| I | ◎ | ◎ | ◎ | ◎ | ◎ | ◎ | ◎ | ◎ | ◎ | ◎ | X | * |
| II | ◎ | ◎ | ○ | ○ | ◎ | ○ | ◎ | ◎ | ◎ | ◎ | X | ◎ |
| III | ◎ | ◎ | ◎ | ◎ | ○ | ◎ | ◎ | ◎ | ◎ | ◎ | ○ | * |
| IV | ◎ | ◎ | ◎ | ◎ | ◎ | ◎ | ◎ | ◎ | ◎ | ◎ | X | ○ |

*: unprintable

ESTIMATION OF PERFORMANCE

I) Release Properties:

Estimation was made of how easily the heat transfer sheet was released from the image-receiving sheet by hand.

◎: Very easy

○: Easy

Δ: The heat transfer sheet remained slightly bonded to the image-receiving sheet.

×: The heat transfer sheet remained bonded to the image-receiving sheet with the peeling of the dye layer.

II) Resolution:

After allowed to stand at 60° C. for 24 hours in a dry state, the heat transfer sheet was printed. Then, the printed image was observed under a microscope.

◎: Very good

○: Good

Δ: Bad

×: Very bad

III) Ability to be laminated:

A 4.5-μm thick polyester film was laminated on the surface of the printed image at a temperature of 150° C., and was then released therefrom by hand.

◎: Unreleasable

○: Releasable

Δ: Easily releasable

×: No adhesion

IV) Storability:

The heat transfer sheet in a roll form was allowed to stand at room temperature for 1 month. Then, the dye layer was visually observed.

◎: The heat transfer sheet underwent no discoloration at all.

○: The heat transfer sheet underwent no or little change.

×: The dye layer was locally fused to the heat-resistant back layer, and became rough on its surface.

REFERENCE EXAMPLE B1

Forty (40) parts of a copolymer (M.W.: 120,000) of 95 mol % of methyl methacrylate with 5 mol % of hydroxyethyl methacrylate were dissolved in 400 parts of a mixed solvent consisting of equal amounts of methyl ethyl ketone and toluene. Then, 10 parts of Polysiloxane Compound (5) having a molecular weight of 3,000 were slowly added dropwise to the solution for a 5-hour reaction at 60° C., which gave a homogeneous product. The product, from which the polysiloxane compound could not be separated by fractional precipitation, was a reaction product of the polysiloxane compound with the acrylic resin. By analysis, the amount of the polysiloxane segment was found to be about 7.4%.

REFERENCE EXAMPLE B2

Fifty (50) parts of polyvinyl butyral (having a polymerization degree of 1,700 and a hydroxyl content of 33 mol %) were dissolved in 500 parts of a mixed solvent consisting of equal amounts of methyl ethyl ketone and toluene. Then, 10 parts of Polysiloxane Compound (5) having a molecular weight of 3,000 were gradually added dropwise to the solution for a 5-hour reaction at 60° C., which gave a homogeneous product. The product, from which the polysiloxane compound could not separated by fractional precipitation, was a reaction product of the polysiloxane compound with the polyvinyl butyral resin. By analysis, the amount of the polysiloxane segment was found to be about 5.2%.

REFERENCE EXAMPLE B3

Seventy (70) parts of a polyester (M.W.: 25,000) of 45 mol % of dimethyl terephthalate, 5 mol % of dimethyl monoaminoterephthalate and 50 mol % of trimethylene glycol were dissolved in 700 parts of a mixed solvent consisting of equal amounts of methyl ethyl ketone and toluene. Then, 10 parts of Polysiloxane Compound (4) having a molecular weight of 10,000 were slowly added dropwise to the solution for a 5-hour reaction at 60° C., which gave a homogeneous product. The product, from which the polysiloxane compound could not separated by fractional precipitation, was a reaction product of the polysiloxane compound with the polyester resin. By analysis, the amount of the polysiloxane segment was found to be about 5.4%.

REFERENCE EXAMPLE B4

Eighty (80) parts of a polyurethane resin (M.W.: 6,000) obtained from polyethylene adipate diol, butanediol and hexamethylene diisocyanate were dissolved in 800 parts of a mixed solvent consisting of equal amounts of methyl ethyl ketone and toluene. Then, 31 parts of Polysiloxane Compound (6) having a molecular weight of 6,000 were slowly added dropwise to the solution for a 5-hour reaction at 60° C., which gave a homogeneous product. The product, from which the polysiloxane compound could not separated by fractional precipitation, was a reaction product of the polysiloxane compound with the polyurethane resin. By analysis, the amount of the polysiloxane segment was found to be about 4.0%.

REFERENCE EXAMPLE B5

One hundred (100) parts of a mixture of 5 mol % of a monomer obtained by the reaction of Polysiloxane Compound (3) (M.W.: 1,000) with methacrylic acid chloride, 45 mol % of methyl methacrylate, 40 mol % of butyl acrylate and 10 mol % of styrene and 3 parts of azobisisobutyronitrile were dissolved in 1,000 parts of a mixed solvent consisting of equal amounts of methyl ethyl ketone and toluene, followed by a 6-hour polymerization at 70° C., which gave a viscous polymer solution in a homogeneous form. From the product, the polysiloxane compound could not be separated by fractional precipitation. By analysis, the amount of the polysiloxane segment was found to be about 6.1%.

REFERENCE EXAMPLE B6

Fifty (50) parts of a styrene/butadiene copolymer (having a molecular weight of 150,000 and a butadiene content of 10 mol %) and 2 parts of azobisisobutyronitrile were dissolved in 500 parts of a mixed solvent consisting of equal amounts of methyl ethyl ketone and toluene. Then, 10 parts of Polysiloxane Compound (7) having a molecular weight of 10,000 were slowly added dropwise to the solution for a 5-hour reaction at 60° C. which gave a homogeneous product. The product, from which the polysiloxane compound could not separated by fractional precipitation, was a reaction product of the polysiloxane compound with the copolymer. By analysis, the amount of the polysiloxane segment was found to be about 6.2%.

REFERENCE EXAMPLE B7

Eighty (80) parts of hydroxyethyl cellulose were dissolved in 800 parts of a mixed solvent consisting of equal amounts of methyl ethyl ketone and toluene. Then, 10 parts of Polysiloxane Compound (6) having a molecular weight of 2,000 were slowly added dropwise to the solution for a 5-hour reaction at 60° C., which gave a homogeneous product. The product, from which the polysiloxane compound could not separated by fractional precipitation, was a reaction product of the polysiloxane compound with hydroxyethyl cellulose. By analysis, the amount of the polysiloxane segment was found to be about 5.8%.

REFERENCE EXAMPLE B8

The procedure of Reference B1 was followed with the exception that Carbon Fluoride Compound (16) was used in place of the polysiloxane compound, thereby obtaining a releasable graft copolymer.

REFERENCE EXAMPLE B9

The procedure of Reference B2 was followed with the exception that Carbon Fluoride Compound (18) was used in place of the polysiloxane compound, thereby obtaining a releasable graft copolymer.

REFERENCE EXAMPLE B10

The procedure of Reference B5 was followed with the exception that a methacrylate of Carbon Fluoride Compound (10) was used in place of the polysiloxane compound, thereby obtaining a releasable graft copolymer.

EXAMPLES B1–B10

Prepared were dye layer-forming ink compositions composed of the following components, each of which was then coated by means of a wire bar coater on a 6-μm thick polyethylene terephthalate, subjected on its back surface to heat-resistant treatments and made its front surface easily bondable, to a dry coverage of 1.0 g/m$^2$. Subsequent drying gave a heat transfer sheet according to this invention. When the resin had a low solubility, methylene chloride was used as a solvent.

| | |
|---|---|
| Disperse dye (Kayaset Blue 714 made by Nippon Kayaku K.K.) | 4.0 parts |
| Graft copolymers of Ref. Ex. Nos. B1–B10 | 4.0 |
| Methyl ethyl ketone/toluene (at a weight ratio of 1:1) | 80.0 |
| Isobutanol | 10.0 |

COMPARATIVE EXAMPLE B1

The procedure of Ex. A1 was followed with the exception that 4.0 parts of 95 mol % of methyl methacrylate with 5 mol % of hydroxyethyl methacrylate and 0.3 parts of silicone oil (dimethylsiloxane) available in the trade name of KF-96 and made by The Shin-Etsu Chemical Co., Ltd.) were used in lieu of the graft copolymer, thereby obtaining a comparative heat transfer sheet.

COMPARATIVE EXAMPLE B2

The procedure of Ex. B1 was followed with the exception that 4.0 parts of polyvinyl butyral (having a polymerization degree of 1,700) and a hydroxyl content of 33 mol % was used in place of the graft copolymer, thereby obtaining a comparative heat transfer sheet.

REFERENCE EXAMPLE B11

With a wire bar coater, 150-μm thick synthetic paper (Yupo FRG-150 made by Oji Yuka K.K.) was coated on its one surface with a coating liquid composed of the following components to a dry coverage of 10.0 g/m$^2$ and was then dried to form a dye-receiving layer. In this way, a heat transfer image-receiving sheet was obtained.

| Composition of coating liquid | |
|---|---|
| Polyester (Vylon 600 made by Toyobo Co., Ltd.) | 11.5 parts |
| Vinyl chloride/vinyl acetate copolymer (VYHH made by UCC) | 5.0 |
| Methyl ethyl ketone/toluene/cyclohexane (at a weight ratio of 4:4:2) | 102.0 |

Each of the heat transfer sheets according to the examples and comparative examples was overlaid on the heat transfer image-receiving sheet, while the dye layer of the former was located in opposition to the dye-receiving surface of the latter. Then, recording was carried out from the back surface of the heat transfer sheet with a heat energy of 90 mJ/mm$^2$ by means of a thermal sublimation transfer printer (VY-50 made by Hitachi, Ltd.). The results are reported in Table 3.

TABLE 3

| Performance | Examples | | | | | | | | | | Comparative Example | |
|---|---|---|---|---|---|---|---|---|---|---|---|---|
| | B1 | B2 | B3 | B4 | B5 | B6 | B7 | B8 | B9 | B10 | B1 | B2 |
| I | ◎ | ◎ | ◎ | ○ | ◎ | ◎ | ◎ | ◎ | ◎ | ◎ | Δ | * |
| II | ○ | ◎ | ○ | ○ | ○ | ○ | ◎ | ○ | ◎ | ○ | X | ◎ |
| III | ◎ | ◎ | ◎ | ◎ | ◎ | ◎ | ◎ | ◎ | ◎ | ◎ | ○ | * |
| IV | ◎ | ◎ | ◎ | ◎ | ◎ | ○ | ◎ | ◎ | ◎ | ◎ | X | ○ |

*: unprintable

ESTIMATION OF PERFORMANCE CHARACTERISTIC

I) Release Properties:

Estimation was made of how easily the heat transfer sheet was released from the image-receiving sheet by hand.

◎: Very easy

○: Easy

Δ: The heat transfer sheet remained slightly bonded to the image-receiving sheet.

×: The heat transfer sheet remained bonded to the image-receiving sheet with the peeling of the dye layer.

II) Resolution:

After allowed to stand at 60° C. for 24 hours in a dry state, the heat transfer sheet was printed. Then, the printed image was observed under a microscope.

◎: Very good

○: Good

Δ: Bad

×: Very bad

III) Ability to be laminated:

A 4.5-μm thick polyester film was laminated on the surface of the printed image at a temperature of 150° C., and was then released therefrom by hand.

◎: Unreleasable

○: Releasable

Δ: Easily releasable

×: No adhesion

IV) Storability:

The heat transfer sheet in a roll form was allowed to stand at room temperature for 1 month. Then, the dye layer was visually observed.

◎: The heat transfer sheet underwent no discoloration at all.

○: The heat transfer sheet underwent no or little change.

×: The dye layer was locally fused to the heat-resistant back layer, and became rough on its surface.

EXAMPLE C1

Preparation of Silicone-Grafted Copolymer

One hundred (100) parts of a solvent consisting of MEK/methyl isobutyl ketone (MIBK for short) were placed in a flask equipped with a stirrer, condenser, thermometer, dropping funnel and $N_2$ inlet pipe. The dropping funnel, on the other hand, was charged with 15 parts of acryl-modified silicone SF41-645 (made by Toshiba Silicone K.K.), 40 parts of methyl methacrylate, 40 parts of butyl methacrylate, 5 parts of 2-hydroxyethyl acrylate and 0.5 parts of azobisisobutyronitrile (AIBN for short). After the solvent was bubbled with $N_2$ and then heated to 80° C., the monomer was added dropwise thereto from the dropping funnel at that temperature over 2 hours. Afterwards, that temperature was held for a further one hour, followed by the feeding of an additional 0.5 parts of AIBN. Heating was carried out at that temperature for a further two hours to bring the polymerization to an end.

In this way, a silicone-grafted-onto-acrylic polymer was obtained.

It is noted that acrylic-modified silicone XF42-645 is represented by:

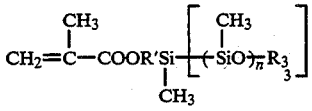

acryl equivalent: 3,700

COMPARATIVE EXAMPLE C1

Synthesis of Modified Acrylic Polymer

One hundred (100) parts of MEK were placed in a flask equipped with a stirrer, condenser, thermometer, dropping funnel and $N_2$ inlet pipe. The dropping funnel, on the other hand, was charged with 40 parts of methyl methacrylate, 20 parts of butyl methacrylate, 5 parts of 3-mercaptopropionic acid and 0.5 parts of AIBN. After the solvent was bubbled with $N_2$ and then heated to 75° C., the monomer was added dropwise thereto from the dropping funnel at that temperature over 2 hours. Afterwards, that temperature was held for a further one hour, followed by the feeding of an additional 0.5 parts of AIBN. Heating was carried out at that temperature for a further two hours to bring the polymerization to an end.

In this way, a carboxyl group-terminated reactive acrylic polymer was obtained.

Preparation 1 of Silicone-Blocked Copolymer

Placed in a flask equipped with a stirrer, condenser and thermometer were 100 parts of a solvent consisting of MEK and MIBK at a weight ratio of 1:1 and 50 parts (on solid content basis) of the carboxy-modified acrylic polymer as synthesized just above. Then, 50 parts of the above solvent and 25 parts of epoxy-modified silicone KF-100 (a modified silicone oil modified by The Shin-Etsu Chemical Co., Ltd.) were fed in a dropping funnel. While the flask was heated to 70° C., the silicone solution was added dropwise to the solvent from the dropping funnel over 1 hour. Heating was then carried out at that temperature for a further three hours to bring the reaction to an end.

In this way, an acrylic-modified silicone-blocked copolymer was synthesized.

It is noted that epoxy-modified silicone oil KF-100 is expressed by:

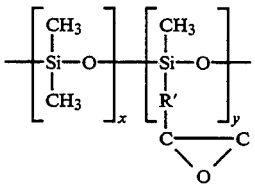

COMPARATIVE EXAMPLE C2

Preparation 2 of Silicone-Blocked Copolymer

According to how to synthesize the aforesaid carboxyl-modified acrylic polymer, a hydroxy-modified acrylic polymer and a hydroxy-modified silicone FM4421 (a silicone oil hydroxy-modified at both its ends, made by Chisso K.K.) were permitted to react with toluene diisocyanate to synthesize a copolymer.

It is noted that hydroxy-modified silicone oil FM4421 is represented by:

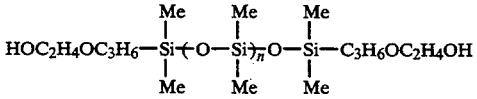

M.W.: 5,000

PRINTING TEST

Preparation of Heat Transfer Sheet

Prepared were dye layer-forming ink compositions composed of the following components, each of which was then coated by means of a wire bar coater on a 6-μm thick polyethylene terephthalate, subjected on its back surface to heat-resistant treatments and made its front surface easily bondable, to a dry coverage of 1.0 g/m². Subsequent drying gave a heat transfer sheet according to this invention.

| | |
|---|---|
| Disperse dye (Kayaset Blue 714 made by Nippon Kayaku K.K.) | 4.0 parts |
| Graft copolymers of Ex. C1 or Comp. Ex. C1 or C2 | 4.0 |
| Methyl ethyl ketone/toluene (at a weight ratio of 1:1) | 80.0 |
| Isobutanol | 10.0 |

Printing Test

For recording, the procedure of Ex. A was followed with the heat transfer image-receiving sheet of Ex. A. The results are reported below.

| | Example C1 | Comp. Example C1 | Comp. Example C2 |
|---|---|---|---|
| I | ◎ | Δ | Δ |
| II | ◎ | X | X |

EXAMPLE D

The following three ink liquid compositions A, B and C were prepared as dye layer-forming inks.

| | |
|---|---|
| Composition A | |
| Dye: | |
| Kayaset Blue 714 made by Nippon Kayaku K.K. | 4.0 parts |
| Binder: | |
| silicone-grafted butyral | 4.0 |
| Solvents: | |
| methyl ethyl ketone | 46.0 |
| toluene | 46.0 |
| Composition B | |
| Dye: | |
| Kayaset Blue 714 made by Nippon Kayaku K.K. | 4.0 parts |
| Binder: | |
| polyvinyl acetal (Slec KS-5 made by Sekisui Chemical Co., Ltd.) | 4.0 |
| Solvents: | |
| methyl ethyl ketone | 46.0 |
| toluene | 46.0 |
| Composition C | |
| Kayaset Blue 714 made by Nippon Kayaku K.K. | 4.0 parts |
| Binder: | |
| polyvinyl acetal (Slec KS-5 made by Sekisui Chemical Co., Ltd.) | X |
| silicone-grafted butyral | Y |
| | wherein X + Y = 4.0 |
| Solvents: | |
| methyl ethyl ketone | 46.0 |
| toluene | 46.0 |

Liquid compositions D and E were prepared as a primer layer to be interleaved between the dye layer and the substrate and an overlay to be formed on the dye layer, respectively.

| | |
|---|---|
| Composition D | |
| Resin: | |
| polyvinyl butyral (BX-1 made by Sekisui Chemical Co., Ltd.) | 4.0 parts |
| Solvents: | |
| methyl ethyl ketone | 48.0 |
| toluene | 48.0 |
| Composition E | |
| Resin: | |
| silicone-grafted butyral | 4.0 parts |
| Solvent: | |
| methyl ethyl ketone | 48.0 |
| toluene | 48.0 |

The silicone-grafted butyral used for Compositions A, C and E was prepared by the aforesaid procedure.

According to such schemes and dry coverages as described in Examples D1–D5 and in Tables 4–8, the aforesaid ink compositions were coated on 6-μm thick polyethylene terephthalate films (6FK203E made by Diaweel Co., Ltd.), each subjected to heat-resistant treatments on its back side and made its front side easily bondable, by means of a wire bar coater. Subsequent drying gave heat transfer sheets.

The thus obtained heat transfer sheets were printed with a test printer so as to confirm their release properties with respect to image-receiving sheets. The adhesion between the substrate films and the dye layers was also confirmed by heat pressing. In order to ascertain the storability of the heat transfer sheets, they were further left in a dry environment of 60° C. for 100–200 hours to make examination of whether or not there was something wrong with the surfaces of the dye layers (dye bleeding) and whether or not there was a drop of printing density.

Test Printer's Operating Conditions

Thermal head:
KMT-85-6MPD2 (made by Kyocera Corporation)
Voltage applied: 11.0 V
Feed rate: 33.3 msec/line
Pulse width: 16.0 msec
Printing temp.: 40° C.

Releasability

Vinyl chloride sheets (Vinyfoil C-8133 made by Mitsubishi Jushi K.K.) were printed to make estimation of whether or not there was releasability. For this purpose, gray scale printing was effected under the aforesaid printer's operating conditions, immediately followed by releasing the heat transfer sheets in a direction of 180° with respect to the printing direction, thereby making a visual estimation of whether or not the heat transfer sheets were fused onto the vinyl chloride sheets. The criteria for estimation are:

IV: No fusion was found with a small peel strength.
III: No fusion was found.
II: Local fusion was found.
I: Across-the-surface fusion was found.

Adhesion to Substrate

A polyester resin (Vylon 600/Vylon 200=1/1 made by Toyobo Co., Ltd.) was coated on one side of a 150-μm thick synthetic paper (Yupo FPG150 made by Oji Yuka K.K.) to a dry coverage of 10.0 g/m$^2$ to prepare an adhesion-measuring sheet. Each of the heat transfer sheets according to this invention was thermally pressed on its dye ink side against the resinous side of the aforesaid measuring sheet at 150° C. and 5 kgf/cm$^2$ for 3 sec. for their full fusion. After left for 1 minute, the heat transfer sheet was released from the measuring sheet in a direction of 180° at a rate of 3 cm/second. The criteria for estimation are:

III: The heat transfer sheet was so torn off that it could not be released from the measuring sheet.

II: The substrate of the heat transfer sheet was locally released from the dye layer, leaving a part of the dye layer deposited onto the measuring sheet. The heat transfer sheet, for the most part, was so torn off due to fusion that it could not be released from the measuring sheet.

I: The substrate of the heat transfer sheet was fully released from the dye layer, leaving the dye layer deposited onto the measuring sheet.

Storability

The heat transfer sheets according to this invention were left in a dry environment of 60° C. for 100–200 hours to make examination of whether or not there was something wrong with the surfaces of the dye layers (dye bleeding). Also, gray scale printing was effected under the aforesaid printer's operating conditions with the aforesaid test printer to make estimation of whether or not there was a drop of printing density. The criteria for estimation are:

V: After left for 200 hours, there was nor anything wrong with the surface of the dye layer nor a drop of printing density.

IV: After left for 100 hours, there was nothing wrong with the surface of the dye layer. After left for 200 hours, some dye bleeding was found but there was no drop of printing density.

III: After left for 100 hours, some dye bleeding was found but there was no drop of printing density.

II: After left for 100 hours, some dye bleeding was found with a drop of printing density.

I: After left for 100 hours, serious dye bleeding was found with an increased drop of printing density.

EXAMPLE D1

Each of the following liquid compositions A was coated on the aforesaid PET film to a dry coverage of 1.0 g/m$^2$ to make a heat transfer sheet. The results are tabulated on the following page.

TABLE 4

| | Scheme of silicone-grafted acetal in liquid composition A | | | | Results of estimation | | |
|---|---|---|---|---|---|---|---|
| No. | Major chain acetal | Polymerization degree | Polymerization degree of siloxane chain | Grafting rate | Releasability | Storability | Adhesion |
| 1 | 3000-2* | 700 | n = 18 | 20% | III | III | II |
| 2 | 3000-K* | 800 | n = 18 | 30% | III | III | II |
| 3 | 3000-K* | 800 | n = 18 | 20% | III | III | II |
| 4 | 3000-K* | 800 | n = 18 | 10% | III | III | II |
| 5 | 3000-K* | 800 | n = 18 | 8% | III | III | III |
| 6 | 3000-K* | 800 | n = 18 | 5% | III | IV | III |
| 7 | 3000-K* | 800 | n = 18 | 2% | III | IV | III |
| 8 | 3000-K* | 800 | n = 28 | 20% | III | III | II |
| 9 | 3000-K* | 800 | n = 28 | 5% | III | IV | II |
| 10 | BX-1** | 1700 | n = 18 | 10% | III | III | II |
| 11 | BX-1** | 1700 | n = 18 | 5% | III | IV | III |
| 12 | 5000-A* | 2000 | n = 18 | 10% | III | IV | III |
| 13 | 6000-C* | 2400 | n = 18 | 10% | III | IV | III |

TABLE 4-continued

| No. | Scheme of silicone-grafted acetal in liquid composition A: Major chain acetal | Polymerization degree | Polymerization degree of siloxane chain | Grafting rate | Results of estimation: Releasability | Storability | Adhesion |
|---|---|---|---|---|---|---|---|
| 14 | KS-5** | 2400 | n = 8 | 5% | IV | V | III |

*Made by Denki Kagaku K.K.
**Made by Sekisui Chemical Co., Ltd.
Nos. 1–13: Major chain polyvinyl butyral
No. 14: Major chain polyvinyl acetacetal

EXAMPLE D2

Each of the following liquid compositions was coated onto the PET film to a dry coverage of 1.0 g/m$^2$ to make a heat transfer sheet.

TABLE 5

| Scheme of silicone-grafted butyral in liquid composition C: Major chain butyral | Polymerization degree of siloxane chain | Grafting rate | X/Y in liquid C (by weight) | Results of estimation: Releasability | Storability | Adhesion |
|---|---|---|---|---|---|---|
| 3000-K | n = 18 | 20% | 3/1 | III | IV | III |
| 3000-K | n = 18 | 20% | 15/1 | III | IV | III |

By forming the dye binder of a mixed system of the silicone-grafted butyral with the polyvinyl acetal resin, rather than of a single silicone-grafted butyral, the resulting storability and adhesion were more improved than those described under No. 3 in Table 4.

EXAMPLE D3

The aforesaid liquid composition B and each of the following liquid compositions A were coated on the PET film in that order to a dry coverage of 1.5 g/m$^2$ to obtain a heat transfer sheet.

TABLE 6

| Scheme of silicone-grafted butyral in liquid composition A: Major chain butyral | Polymerization degree of siloxane chain | Grafting rate | Results of estimation: Releasability | Storability | Adhesion |
|---|---|---|---|---|---|
| 3000-K | n = 28 | 20% | III | III | III |
| 3000-K | n = 28 | 5% | III | IV | III |

By forming the dye layer of a double layer structure and coating the substrate with the ink in which the polyvinyl acetal resin was used as a binder, the adhesion between the dye layer and the substrate was more improved than that described under No. 8 or 9 in Table 4.

EXAMPLE D4

The aforesaid liquid composition D and each of the following liquid compositions A were coated on the PET film to a coverage of 1.3 g/m$^2$ and a dry coverage of 1.2 g/m$^2$, respectively, thereby obtaining a heat transfer sheet. The results are tabulated below.

TABLE 7

| Scheme of silicone-grafted butyral in liquid composition A: Major chain butyral | Polymerization degree of siloxane chain | Grafting rate | Results of estimation: Releasability | Storability | Adhesion |
|---|---|---|---|---|---|
| 3000-K | n = 28 | 20% | III | III | III |

TABLE 7-continued

| Scheme of silicone-grafted butyral in liquid composition A: Major chain butyral | Polymerization degree of siloxane chain | Grafting rate | Results of estimation: Releasability | Storability | Adhesion |
|---|---|---|---|---|---|
| 3000-K | n = 28 | 5% | III | IV | III |

By interleaving the polyvinyl butyral resin between the substrate and the dye layer as a primer layer, the adhesion therebetween was more improved than that reported under No. 8 or 9 in Table 4.

EXAMPLE D5

The aforesaid liquid composition B and each of the following liquid compositions E (a coverage of 0.2 g/m$^2$) were coated on the PET film in that order (to a dry coverage of 1.3 g/m2).

TABLE 8

| Scheme of silicone-grafted butyral in liquid composition A: Major chain butyral | Polymerization degree of siloxane chain | Grafting rate | Results of estimation: Releasability | Storability | Adhesion |
|---|---|---|---|---|---|
| 3000-K | n = 18 | 2% | III | IV | III |
| BX-1 | n = 18 | 5% | III | IV | III |
| No overlay (liquid E) was used (Comp. Ex.) | | | I | IV | III |

More improved releasability was obtained by coating an overlay of the silicone-grafted butyral resin on the dye layer in which the polyvinyl acetal resin was used as a binder.

COMPARATIVE EXAMPLE D

According to such schemes as described in Example D5, heat transfer sheets were obtained with the following two overlay coating liquid compositions F and G, and was then estimated.

(a) Releasability
(b) Storability
(c) Adhesion

These properties were estimated according to the foregoing procedures.

(d) Recording density

Image-receiving sheets were printed with the aforesaid test printer and under the aforesaid printer's operating conditions to measure the resulting density.

○: Max. O.D. of 2.0 or more
×: Max. O.D. of 2.0 or less (e) Uniformity of printing surface Image-receiving sheets were printed with the aforesaid test-printer and under the aforesaid printer's operating conditions to observe the resulting printing surfaces visually.

○: Good printing surfaces free from white spots.
×: White spots, mats, etc. were found on the printing surfaces.

The overlay coating liquid compositions F and G are as follows.

| | |
|---|---|
| Composition F | |
| Heat-curable silicone (KS774 made by The Shin-Etsu Chemical Co., Ltd.) | 30.0 parts |
| Curing catalyst (CAT-PL-4 made by The Shin-Etsu Chemical Co., Ltd.) | 1.0 |
| Solvent (toluene) | 69.0 |
| Composition G | |
| Silicone oil (dimethylsiloxane: TSF451-350 Toshiba Silicone K.K.) | 20.0 parts |
| Methyl ethyl ketone | 40.0 |
| Toluene | 40.0 |

The liquid compositions B and F (at a coverage of 0.2 g/m$^2$) were coated on a PET film in that order (to a dry coverage of 1.3 g/m$^2$) and the liquid compositions B and G (at a coverage of 0.1 g/m$^2$) on a PET film in that order (to a dry coverage of 1.4 g/m$^2$). The results of estimation were tabulated below.

TABLE 9

| Type of overlay coating | Results of Estimation | | | | |
|---|---|---|---|---|---|
| | Releasability | Storability | Adhesion | Recording density | Uniformity of printed surface |
| Comp. E (as described in Ex. D5) | III | IV | III | ○ | ○ |
| Comp. F | III | II | III | X | X |
| Comp. G | II | I | III | ○ | X |

INDUSTRIAL APPLICABILITY

The heat transfer sheets according to this invention are widely usable as ink donor sheets for the heat transfer system making use of thermal printing means such as a thermal head.

What is claimed is:

1. A heat transfer sheet comprising:

a substrate film; and a dye layer formed on said substrate film, said dye layer comprising a dye, a binder resin and a release agent, said release agent comprising a graft copolymer including a major chain and at least one releasable segment graft-bonded thereto, said at least one releasable segment comprising at least one releasable segment selected from polysiloxane segments, fluorinated carbon segments and long-chain alkyl segments.

2. A heat transfer sheet as claimed in claim 1, wherein the major chain of said graft copolymer is compatible with said binder resin.

3. A heat transfer sheet as claimed in claim 1, wherein the major chain of said graft copolymer is one of an acrylic, vinylic, polyester, polyurethane, polyamide and cellulosic polymer.

4. A heat transfer sheet as claimed in claim 1, wherein the surface of said substrate film is treated to be easily bondable.

5. A heat transfer sheet as claimed in claim 1, wherein the major chain of said graft copolymer is a polyvinyl acetal.

6. A heat transfer sheet as claimed in claim 5, wherein said polyacetal is polyvinyl butyral.

7. A heat transfer sheet as claimed in claim 5, wherein said polyacetal is polyvinyl acetacetal.

8. A heat transfer sheet as claimed in claim 1, wherein said dye layer comprises two sublayers, a first dye sublayer thereof containing a polyvinyl acetal onto which no silicone is grafted and a second dye sublayer containing a release agent comprising a silicone-grafted-onto-acetal polymer, said first and second sublayers being laminated on the surface of said substrate film in that order.

9. A heat transfer sheet as claimed in claim 1, wherein a primer layer comprising a polyvinyl acetal resin is interposed between said substrate film and said dye layer.

10. A heat transfer sheet as claimed in claim 1, wherein said dye layer contains inorganic or organic powders in a finely divided form.

11. A heat transfer sheet comprising:

a substrate film; and a dye layer formed on said substrate film, said dye layer comprising a dye and a binder resin, said binder resin comprising a graft copolymer including a major chain and at least one releasable segment graft-bonded thereto, said at least one releasable segment comprising at least one releasable segment selected from polysiloxane segments, fluorinated carbon segments and long-chain alkyl segments.

12. A heat transfer sheet as claimed in claim 11, wherein the major chain of said graft copolymer is an acrylic, vinylic, polyester, polyurethane, polyamide or cellulosic polymer.

13. A heat transfer sheet as claimed in claim 11, wherein the surface of said substrate film is treated to be easily bondable.

14. A heat transfer sheet as claimed in claim 13, wherein the major chain of the graft copolymer is a polyvinyl acetal.

15. A heat transfer sheet as claimed in claim 14, wherein said polyacetal is polyvinyl butyral.

16. A heat transfer sheet as claimed in claim 14, wherein said polyacetal is polyvinyl acetacetal.

17. A heat transfer sheet as claimed in claim 11, wherein said dye layer comprises two sublayers, a first dye sublayer thereof containing a polyvinyl acetal onto which no silicone is grafted and a second dye sublayer containing a release agent comprising a silicone-grafted-onto-acetal polymer, said first and second sublayers being laminated on the surface of said substrate film in that order.

18. A heat transfer sheet as claimed in claim 13, wherein a primer layer comprising a polyvinyl acetal resin is interposed between said substrate film and said dye layer.

19. A heat transfer sheet as claimed in claim 13, wherein said dye layer contains inorganic or organic powders in a finely divided form.

20. A heat transfer sheet comprising:

a substrate film;

a dye layer formed on said substrate film, said dye layer comprising a dye and a binder resin; and an overlay layer formed on said dye layer, said overlay layer containing a release agent comprising a graft copolymer including a major chain and at least one releasable segment graft-bonded thereto, said at least one releasable segment comprising at least one releasable segment selected from polysiloxane segments, fluorinated carbon segments and long-chain alkyl segments, said major chain comprising at least one polyvinyl acetal.

21. A heat transfer sheet as claimed in claim 20, wherein the major chain of said graft copolymer is a polyvinyl acetal.

22. A heat transfer sheet as claimed in claim 21, wherein said polyacetal is polyvinyl butyral.

23. A heat transfer sheet as claimed in claim 21, wherein said polyacetal is polyvinyl acetacetal.

24. A heat transfer sheet as claimed in claim 20, wherein the binder resin contained in said dye layer comprises a polyvinyl acetal onto which no silicone is grafted, and the release agent contained in said overlay layer comprises a silicone-grafted-onto-acetal polymer.

25. A heat transfer sheet as claimed in claim 20, wherein said dye layer contains inorganic or organic powders in a finely divided form.

* * * * *